US010352605B2

(12) United States Patent
Pereira Zimmermann et al.

(10) Patent No.: US 10,352,605 B2
(45) Date of Patent: Jul. 16, 2019

(54) COOLING SYSTEM WITH INTERMEDIATE HEAT EXCHANGE FLUID LOOP

(71) Applicant: Heatcraft Refrigeration Products LLC, Stone Mountain, GA (US)

(72) Inventors: Augusto J. Pereira Zimmermann, Lilburn, GA (US); Robert H. Austin, Jr., Pine Mountain, GA (US)

(73) Assignee: Heatcraft Refrigerator Products, LLC, Stone Mountain, GA (US)

( * ) Notice: Subject to any disclaimer, the term of this patent is extended or adjusted under 35 U.S.C. 154(b) by 213 days.

(21) Appl. No.: 15/432,550

(22) Filed: Feb. 14, 2017

(65) Prior Publication Data

US 2018/0231290 A1 Aug. 16, 2018

(51) Int. Cl.
*F25B 49/02* (2006.01)
*F25B 5/02* (2006.01)
(Continued)

(52) U.S. Cl.
CPC ..... *F25B 49/02* (2013.01); *F25B 5/02* (2013.01); *F25B 25/005* (2013.01); *F25B 41/04* (2013.01);
(Continued)

(58) Field of Classification Search
CPC .... F25B 49/02; F25B 5/02; F25B 7/00; F25B 41/04; F25B 2700/19; F25B 2400/06; F25B 2400/05
(Continued)

(56) References Cited

U.S. PATENT DOCUMENTS

2007/0074863 A1* 4/2007 Ichinose ..... G05D 23/192 165/247
2013/0000340 A1* 1/2013 Takayama ..... F25B 9/008 62/222
(Continued)

FOREIGN PATENT DOCUMENTS

EP 2937648 A1 10/2015
JP S6410062 A * 1/1989
(Continued)

OTHER PUBLICATIONS

Yokoyama Keizo, Oct. 2014, European Patent Office, English Translation (Year: 2014).*
(Continued)

*Primary Examiner* — Frantz F Jules
*Assistant Examiner* — Steve S Tanenbaum
(74) *Attorney, Agent, or Firm* — Baker Botts L.L.P.

(57) ABSTRACT

An apparatus includes a first compressor, a first load, a second compressor, a second load, a first heat exchanger, and a second heat exchanger. The first compressor compresses a first refrigerant. The first load uses the first refrigerant to remove heat from a space proximate the first load. The first load sends the first refrigerant to the first compressor. The second compressor compresses a second refrigerant. The second load uses the second refrigerant to remove heat from a space proximate the second load. The second load sends the second refrigerant to the second compressor. The first heat exchanger receives the first refrigerant from the first compressor. The first heat exchanger transfers heat from the first refrigerant to a fluid. The second heat exchanger receives the second refrigerant from the second compressor. The second heat exchanger transfers heat from the fluid to the second refrigerant.

23 Claims, 7 Drawing Sheets

(51) Int. Cl.

| | |
|---|---|
| ***F25B 41/04*** | (2006.01) |
| ***F25B 25/00*** | (2006.01) |
| *F25B 7/00* | (2006.01) |
| *F25B 9/00* | (2006.01) |

(52) U.S. Cl.
CPC ..... *F25B 7/00* (2013.01); *F25B 9/008* (2013.01); *F25B 2400/0403* (2013.01); *F25B 2400/05* (2013.01); *F25B 2400/06* (2013.01); *F25B 2400/22* (2013.01); *F25B 2500/09* (2013.01); *F25B 2500/27* (2013.01); *F25B 2600/13* (2013.01); *F25B 2600/2501* (2013.01); *F25B 2700/1933* (2013.01); *F25B 2700/2103* (2013.01)

(58) Field of Classification Search
USPC ..... 62/335
See application file for complete search history.

(56) References Cited

U.S. PATENT DOCUMENTS

| | | | | |
|---|---|---|---|---|
| 2015/0191182 | A1 | 7/2015 | Abou Eid et al. | |
| 2015/0204595 | A1* | 7/2015 | Sunderland ..... | F25B 25/005 165/295 |

FOREIGN PATENT DOCUMENTS

| | | | |
|---|---|---|---|
| JP | 2014190587 | A * | 10/2014 |
| WO | 2016075044 | A1 | 5/2016 |

OTHER PUBLICATIONS

Extended European Search Report, Application No. 18155952.7, dated Jul. 23, 2018, 8 pages.

* cited by examiner

COOLING SYSTEM WITH INTERMEDIATE HEAT EXCHANGE FLUID LOOP

TECHNICAL FIELD

This disclosure relates generally to a cooling system.

BACKGROUND

Cooling systems may cycle a refrigerant to cool a space. Existing cooling systems may be replaced with new cooling systems using a different refrigerant. The installation of the new cooling system may be done in stages in order to allow for the continued cooling of spaces during the retrofit. During the installation, loads for both the new and the old cooling systems may be used to cool spaces.

SUMMARY OF THE DISCLOSURE

According to one embodiment, an apparatus includes a first compressor, a first load, a second compressor, a second load, and a heat exchanger. The first compressor compresses a first refrigerant. The first load uses the first refrigerant to remove heat from a space proximate the first load. The first load sends the first refrigerant to the first compressor. The second compressor compresses a second refrigerant. The second load uses the second refrigerant to remove heat from a space proximate the second load. The second load sends the second refrigerant to the second compressor. The heat exchanger receives the first refrigerant from the first compressor and receives the second refrigerant from the second compressor. The heat exchanger transfers heat from the first refrigerant to the second refrigerant. The heat exchanger discharges the first refrigerant to the first load and discharges the second refrigerant to the second compressor.

According to another embodiment, an apparatus includes a first compressor, a first load, a second compressor, a second load, a first heat exchanger, and a second heat exchanger. The first compressor compresses a first refrigerant. The first load uses the first refrigerant to remove heat from a space proximate the first load. The first load sends the first refrigerant to the first compressor. The second compressor compresses a second refrigerant. The second load uses the second refrigerant to remove heat from a space proximate the second load. The second load sends the second refrigerant to the second compressor. The first heat exchanger receives the first refrigerant from the first compressor. The first heat exchanger transfers heat from the first refrigerant to a fluid. The second heat exchanger receives the second refrigerant from the second compressor. The second heat exchanger transfers heat from the fluid to the second refrigerant.

According to yet another embodiment, an apparatus includes a compressor, a load, a heat exchanger, and a heater. The compressor compresses a refrigerant. The load uses the refrigerant to remove heat from a space proximate the load. The load sends the refrigerant to the compressor. The heat exchanger receives the refrigerant from the compressor. The heat exchanger transfers heat from a fluid to the refrigerant. The heat exchanger discharges the refrigerant to the compressor. The heater adds heat to the fluid.

Certain embodiments may provide one or more technical advantages. For example, an embodiment allows a new cooling system to operate more efficiently by transferring heat to a refrigerant of the new cooling system when the new cooling system is installed in stages to replace an old cooling system. As another example, an embodiment allows a new cooling system to operate more efficiently by transferring heat from a refrigerant used by an old cooling system to a refrigerant of the new cooling system during the installation of the new cooling system in stages to replace the old cooling system. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
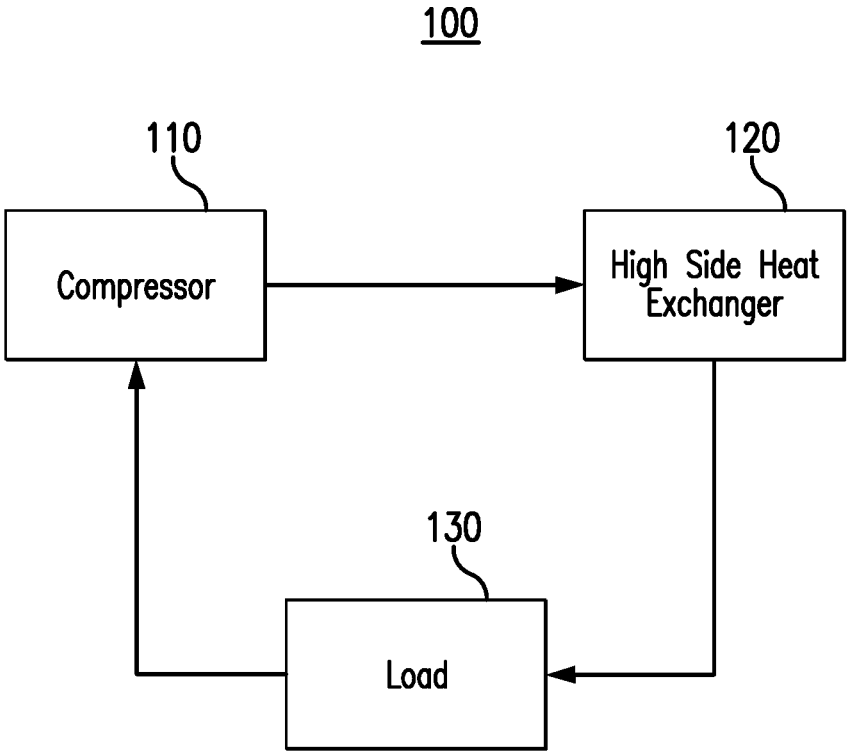
FIG. 1 illustrates an example cooling system.

Embodiments of the present disclosure and its advantages are best understood by referring to FIGS. 1 through 7 of the drawings, like numerals being used for like and corresponding parts of the various drawings.

Cooling systems, such as for example refrigeration systems, use a refrigerant to remove heat from a space. These systems may cycle refrigerant through a plurality of loads located through a building. For example, in a grocery store, loads may be freezers used to store frozen foods or refrigerated shelves used to store fresh produce. Refrigerant may cycle through these freezers and shelves where it is used to remove heat from those spaces.

These cooling systems may be upgraded to or replaced with more efficient and cost effective cooling systems that use a different refrigerant. For example, an operator may install a carbon dioxide refrigeration system to replace a HFC refrigeration system. A carbon dioxide system may be desired because it runs more efficiently or because it is necessary to comply with environmental regulations. In some situations, installing a new cooling system may be done in stages to minimize the impact of the installation process on a business or organization (e.g., a grocery store, gas station, school, etc.). By installing the new cooling system in stages, only certain portions of the old cooling system are subjected to the installation process at any given time. As a result, during the installation process, both the new cooling system and the old cooling system will be operating to remove heat from various spaces. As the installation progresses, more spaces will be cooled by the new cooling system and fewer spaces will be cooled by the older cooling system. Eventually, the new cooling system will be fully installed to remove heat from all the spaces, and the old cooling system may be removed.

During the intermediary stages before completing the installation, the new cooling system may only cycle its refrigerant to loads representing a small fraction of the cooling system's capacity. For example, if a grocery store has ten freezer units and ten refrigeration shelves, during a first stage of a retrofit, the new cooling system may only be responsible for two freezer units and two refrigeration shelves. Operating significantly below capacity may cause the compressors of the new cooling system to cycle on and off repeatedly. As a result, the new cooling system may consume more energy and require more maintenance, which may increase costs of operation.

This disclosure contemplates a cooling system that includes a heat exchanger that transfers heat to a refrigerant used in the newly installed system during the retrofit. By transferring heat to the refrigerant of the new cooling system, the new cooling system is effectively subject to a larger load, thereby increasing its operating efficiency. In particular embodiments, heat from a first refrigerant used by the old system is transferred to a second refrigerant used by the new system. In such embodiments, there is an added advantage that the new system may reduce the load on the old system without first having to install the loads in the new system. In some embodiments, an intermediary fluid may be used to transfer heat from the first refrigerant to the second refrigerant. The use of the fluid may increase the control over the transfer of heat, creating an optimal load increase for the new system. In even further embodiments, heat is not transferred to the refrigerant of the new system from another refrigerant, but instead from a fluid heated by a heater.

As described above, there are numerous challenges in removing heat from a space when installing a new system. The new system may be installed in stages wherein the load on the new system is relatively low compared to the load it will experience when fully installed. The descriptions below may provide a solution to the various challenges described above and enable an operator or owner of a store to efficiently use the new cooling system during the various stages of the installation.

Figure 2:
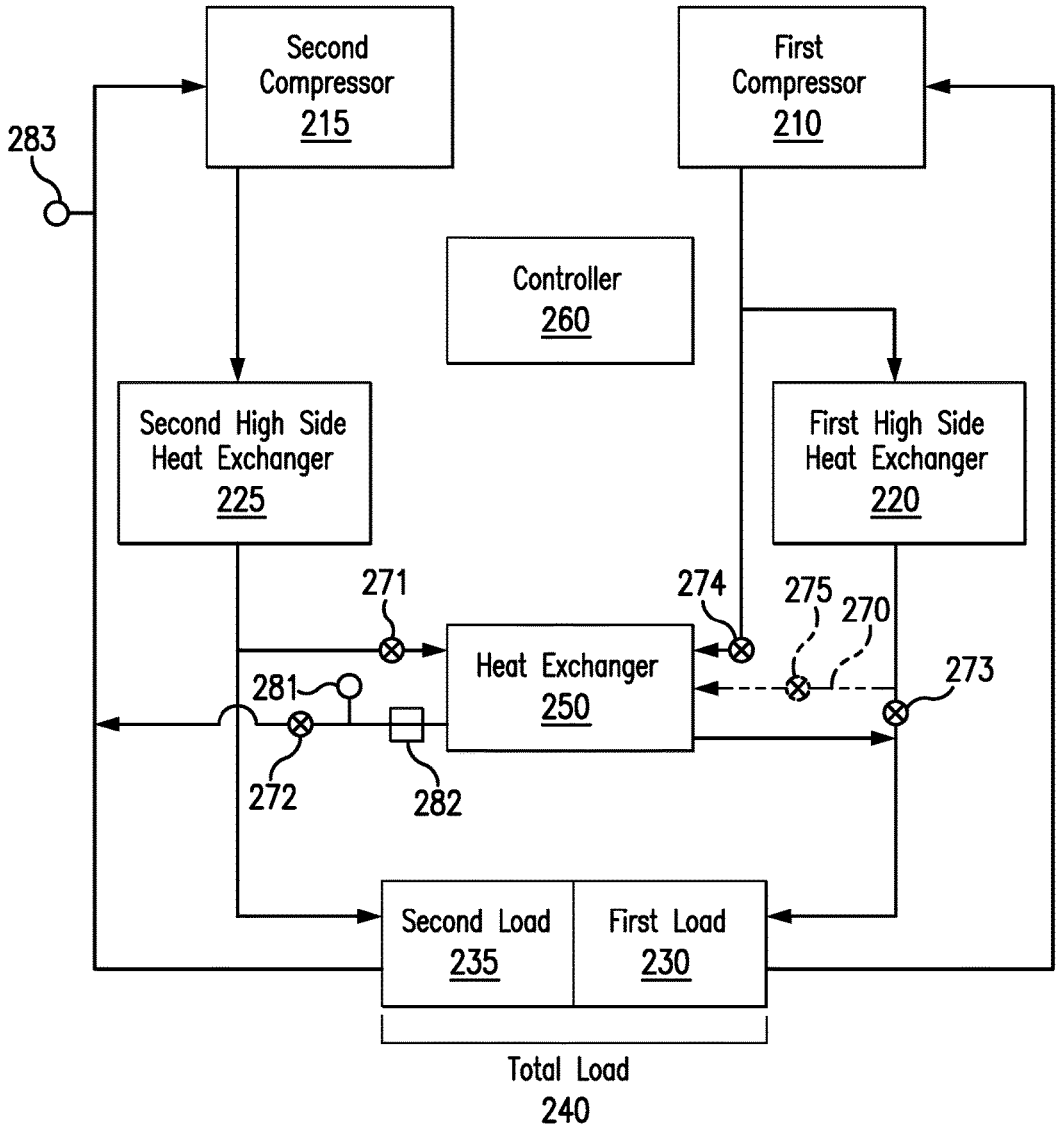
FIG. 2 illustrates an example cooling system having a heat exchanger.
Figure 3:
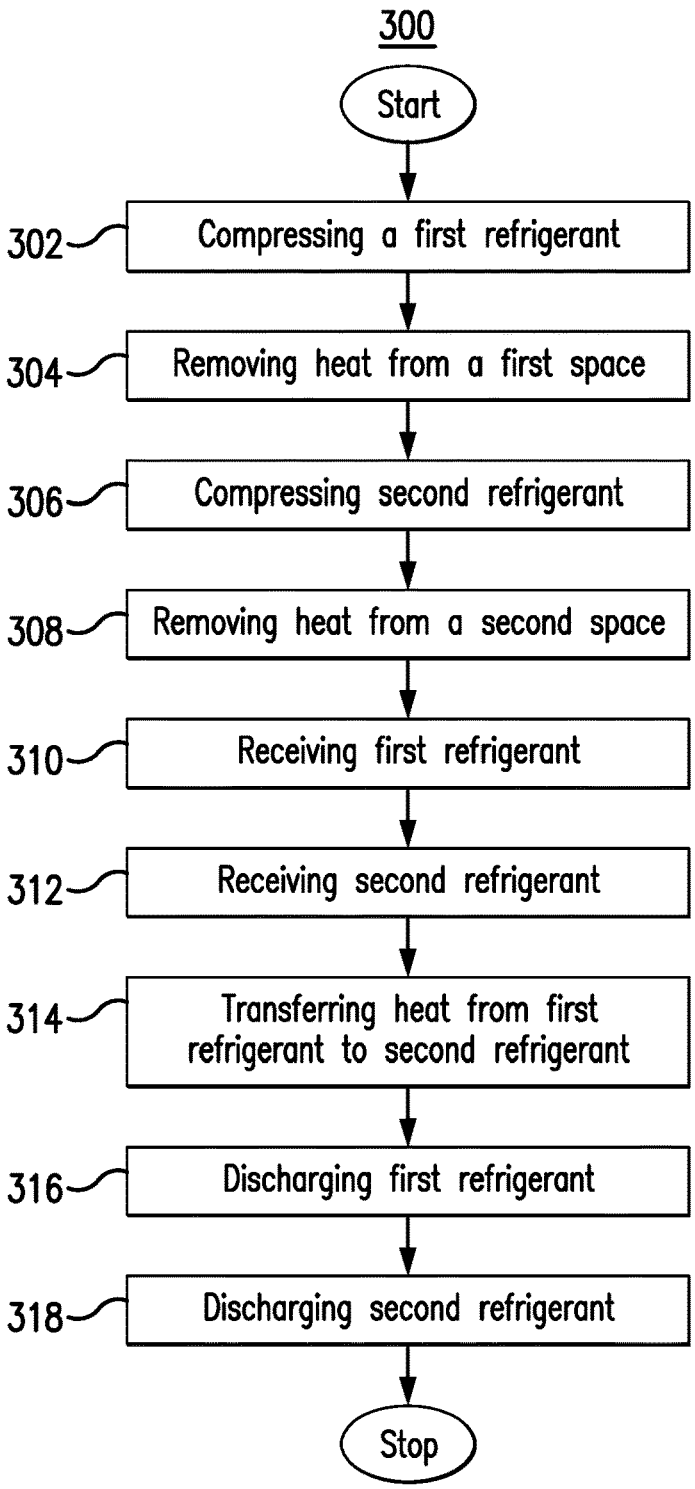
FIG. 3 is a flowchart illustrating a method of operating the example cooling system of FIG. 2.
Figure 4:
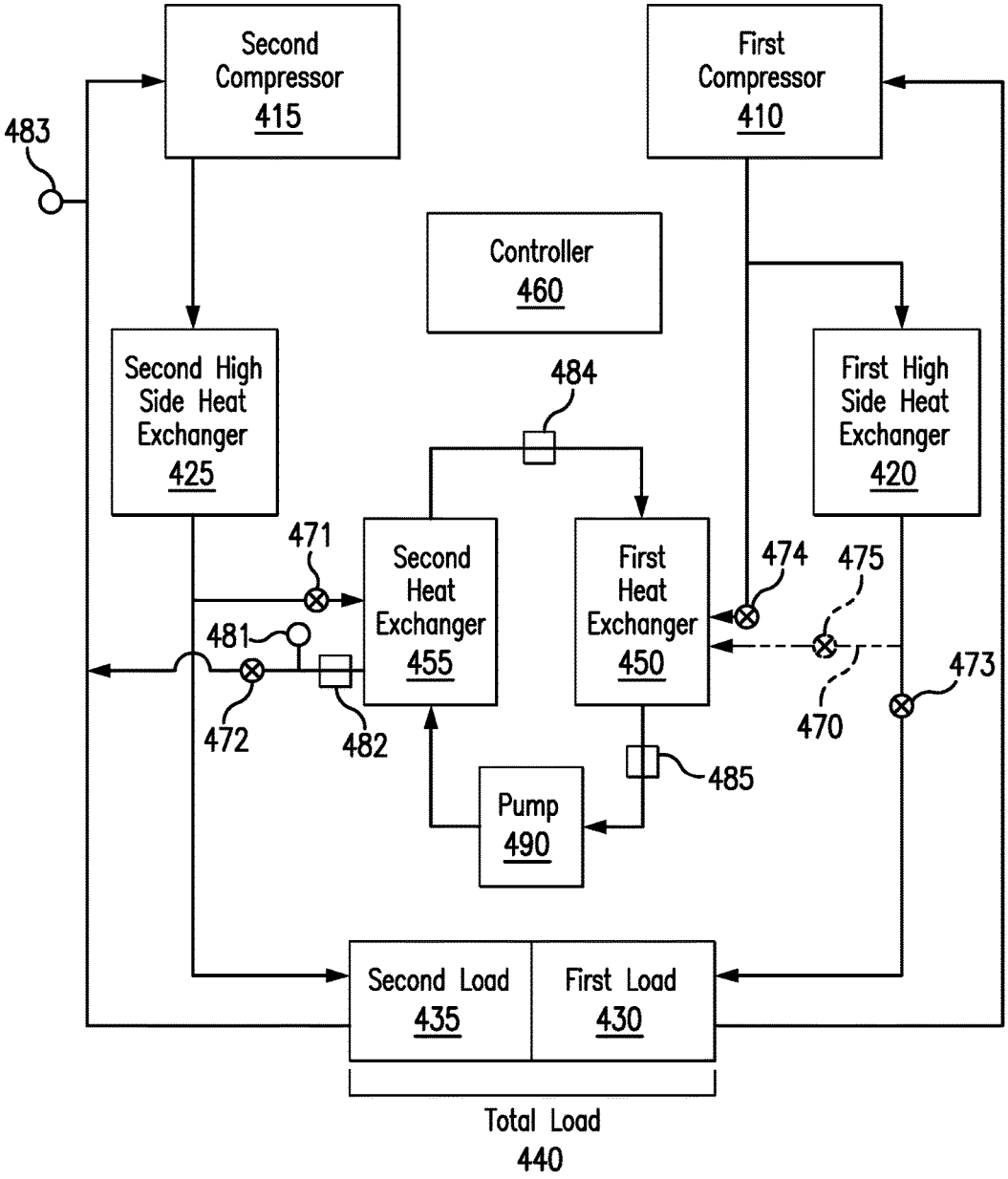
FIG. 4 illustrates an example cooling system having a heat exchanger.
Figure 5:
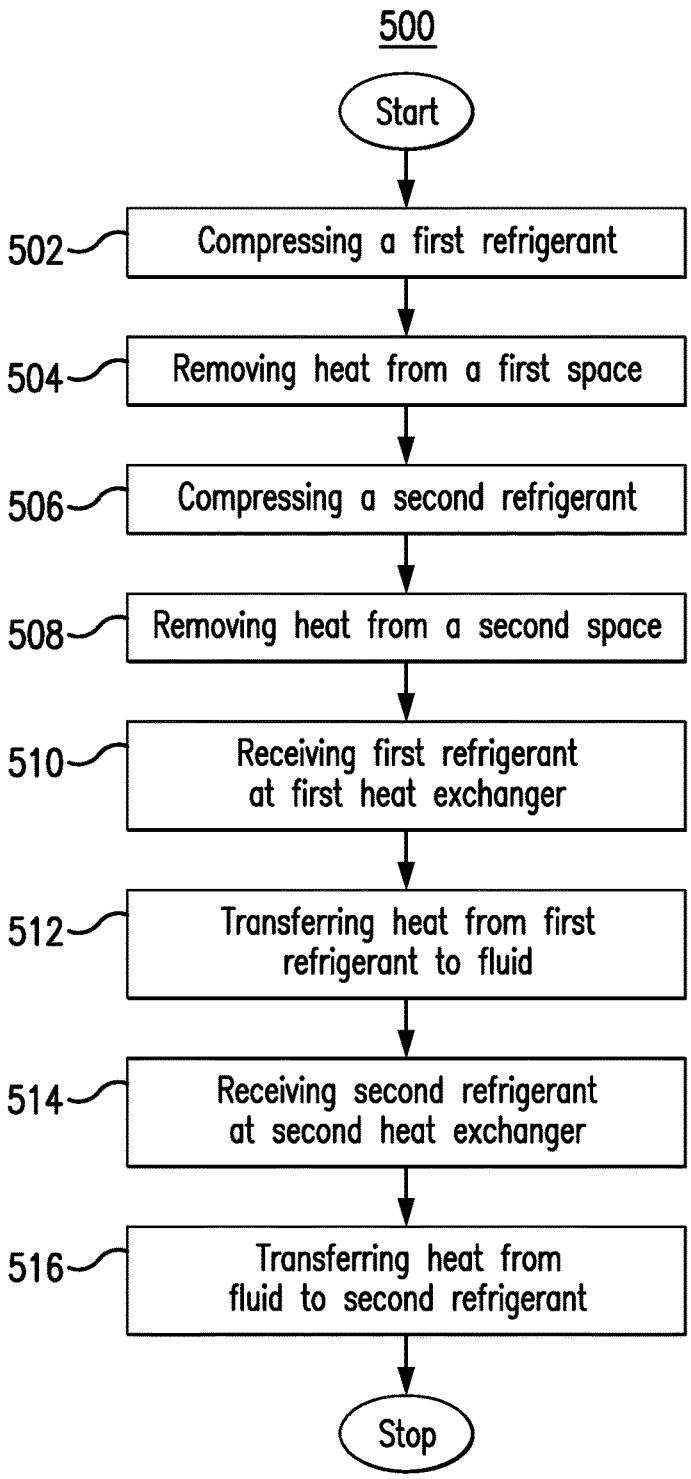
FIG. 5 is a flowchart illustrating a method of operating the example cooling system of FIG. 4.
Figure 6:
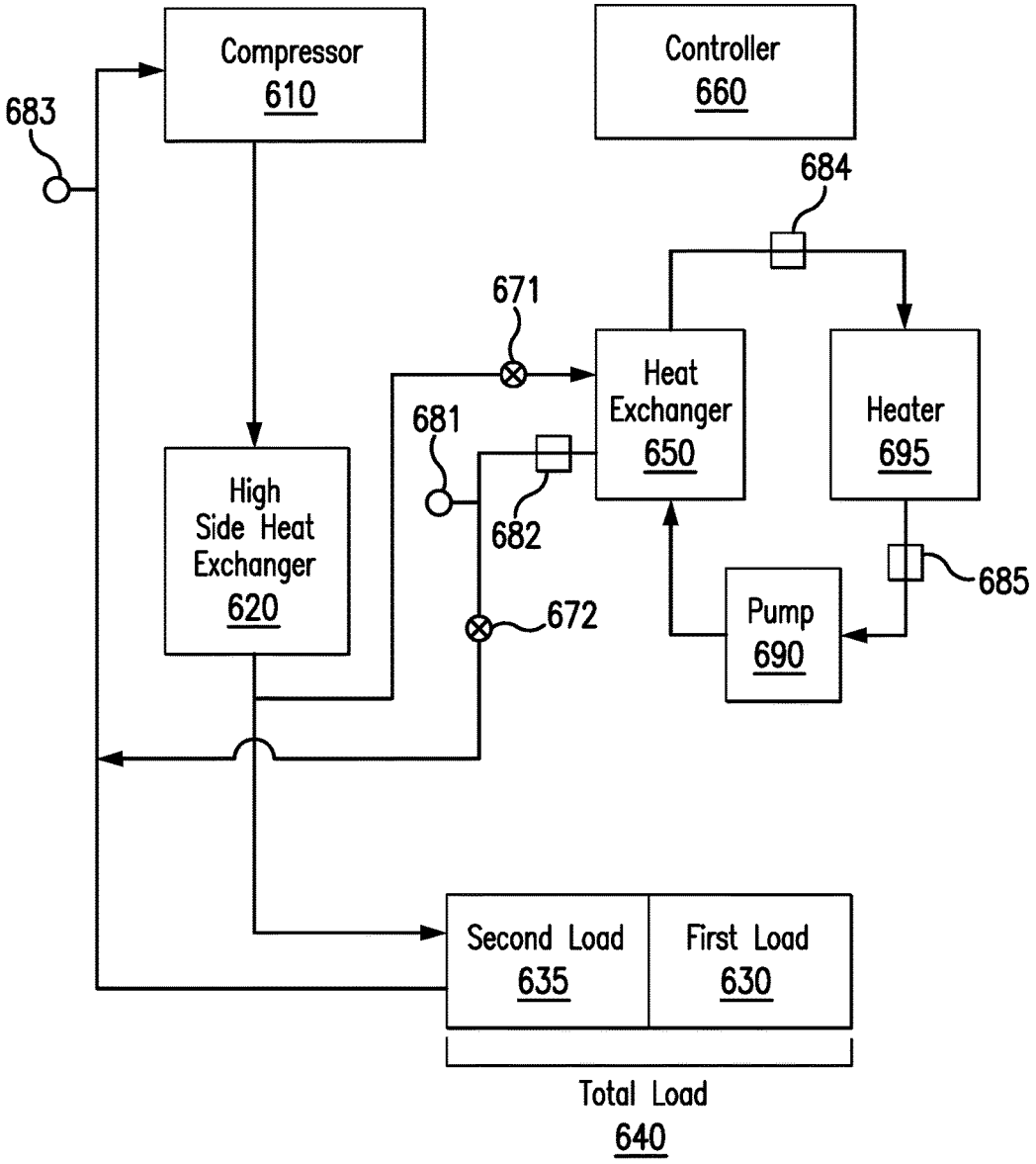
FIG. 6 illustrates an example cooling system having a heat exchanger.
Figure 7:
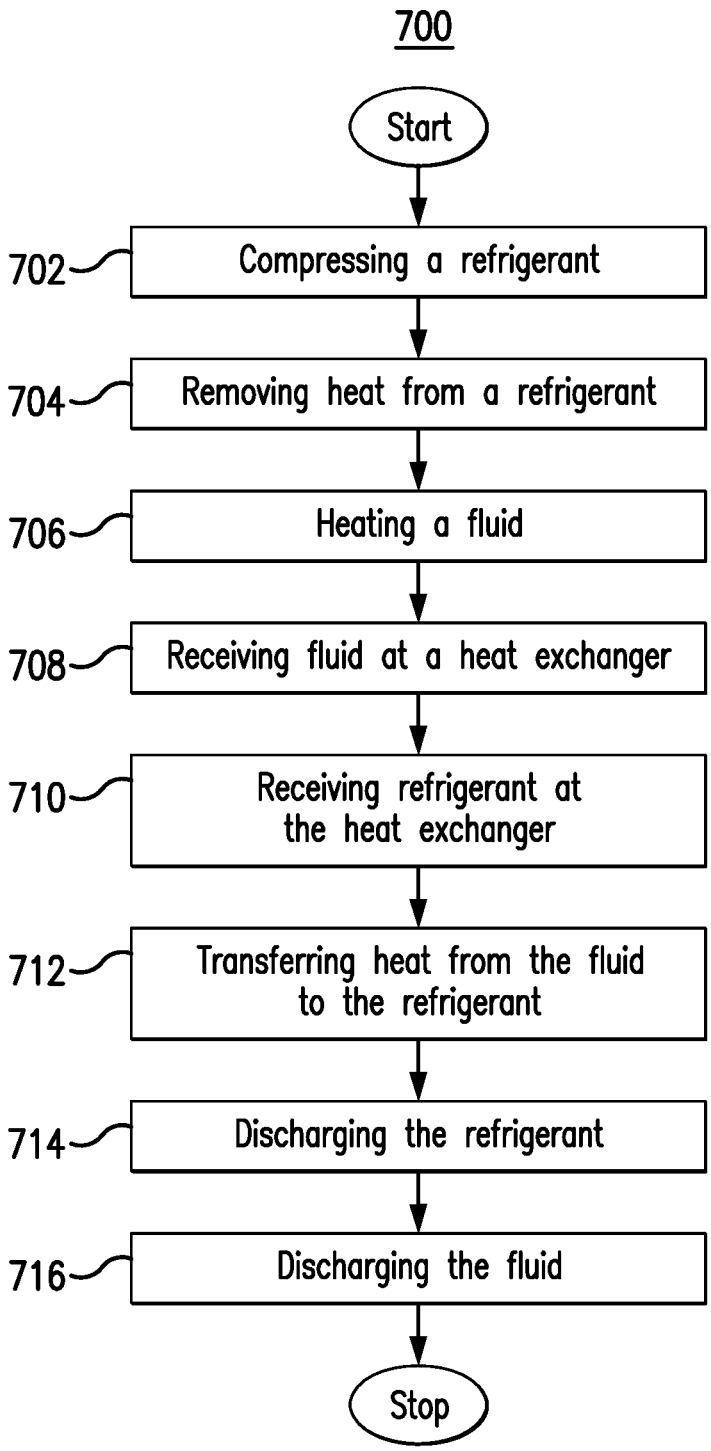
FIG. 7 is a flowchart illustrating a method of operating the example cooling system of FIG. 6.

The cooling system will be described in more detail using FIGS. 1 through 7. FIG. 1 shows a cooling system generally. FIG. 2 shows a first example of a cooling system providing heat transfer to the refrigerant of the new system. FIG. 3 shows a method of operating the first example cooling system. FIG. 4 shows a second example of a cooling system using a fluid to control the transfer of heat to the refrigerant of the new system. FIG. 5 shows a method of operating the second example cooling system. FIG. 6 shows a third example of a cooling system which uses a heater to provide the transferred heat to the refrigerant. FIG. 7 shows a method of operating the third example cooling system.

FIG. 1 depicts a generalized cooling system illustrating the flow of refrigerant in order to remove heat from a space. Cooling system 100 includes compressor 110, high side heat exchanger 120, and load 130. These components cycle a refrigerant to remove heat from a space proximate load 130.

Refrigerant may flow from load 130 to compressor 110. This disclosure contemplates cooling system 100 including any number of compressors 110. For example, compressor 210 may be a plurality of compressors connected in parallel or series. Compressor 110 may be configured to increase the pressure of the refrigerant. As a result, the heat in the refrigerant may become concentrated and the refrigerant may become a high pressure gas. Compressor 110 may send the compressed refrigerant to high side heat exchanger 120.

High side heat exchanger 120 may receive the refrigerant from compressor 110 and remove heat from it. High side heat exchanger 120 may operate as a gas cooler or as a condenser. After removing heat from the refrigerant, high side heat exchanger 120 may send the refrigerant to load 130.

Load 130 uses the refrigerant to remove heat from a space. For example, when the refrigerant reaches load 130, the refrigerant removes heat from the air around load 130. As a result, the air is cooled. The cooled air may then be circulated such as, for example, by a fan to cool a space such as, for example, a freezer and/or a refrigerated shelf. As refrigerant passes through load 130 the refrigerant may change from a liquid to a gaseous state. The refrigerant may be discharged from load 130 back to compressor 110 so that it may be compressed again.

In a business or organization, such as a grocery store for example, cooling system 100 may include multiple loads 130 to remove heat from multiple spaces. When cooling system 100 needs to be replaced by a new cooling system, the new cooling system may be installed in stages to minimize the impact on the grocery store. During each stage, the new cooling system may installed so that it handles a greater number of loads 130 while cooling system 100 is removed so that it handles fewer loads 130.

As a consequence of staged installation, the new cooling system may operate at low efficiency during certain stages where the new cooling system is tasked with handling a small number of loads 130. Because a small number of loads 130 does not generate enough heat, a compressor of the new cooling system may cycle on and off continuously, thus leading to a low operating efficiency. This disclosure contemplates systems that transfer heat to a refrigerant of the new cooling system during the installation process to improve the operating efficiency of the new cooling system. These systems will be described in more detail using FIGS. 2 through 7.

FIG. 2 illustrates an example cooling system 200 having a heat exchanger. Cooling system 200 includes a first compressor 210, a second compressor 215, a first high side heat exchanger 220, a second high side heat exchanger 225, a first load 230, a second load 235, and a heat exchanger 250. In particular embodiments, cooling system 200 includes a controller 260, a pressure sensor 281, a temperature sensor 282, and a second pressure sensor 283. In particular embodiments, cooling system 200 further includes a part load path 270 coupled to heat exchanger 250 and first high side heat exchanger 220. First compressor 210 may be configured to compress a first refrigerant. First high side heat exchanger 220 may be configured to remove heat from the first refrigerant. First load 230 may use the first refrigerant to remove heat from a space proximate to first load 230. After removing heat from the space, first load 230 may send the first refrigerant to first compressor 210 to repeat the cycle.

Second compressor 215 may compress the second refrigerant. Second high side heat exchanger 225 may be configured to remove heat from the second refrigerant. Second load 235 may receive the second refrigerant and use it to remove heat from a space proximate to second load 225. The second refrigerant may then, be sent from second load 235 back to second compressor 215.

In this manner, first compressor 210 and second compressor 215 may be used in separate cooling cycles similar to the generalized cooling system 100 in FIG. 1. The different cycles may use different refrigerant as well as different numbers or types of components. Cooling system 200 contemplates a transfer of heat between the refrigerants of the two, separate cycles.

Heat exchanger 250 may receive the first refrigerant from first compressor 210 and receive the second refrigerant from second compressor 215. As shown in FIG. 2, heat exchanger 250 may receive the second refrigerant from second compressor 215 after the second refrigerant flows through second high side heat exchanger 225. Having received both the first refrigerant and the second refrigerant, heat exchanger 250 may transfer heat from the first refrigerant to the second refrigerant. A person having skill in the art would recognize there are a number of suitable ways to transfer heat from the first refrigerant to the second refrigerant at heat exchanger 250. For example, heat may be transferred while maintaining the two refrigerants separate, to prevent mixing. In the case where the first refrigerant and the second refrigerant are different, it may be necessary for heat exchanger 250 to maintain separation between the two refrigerants because the different systems are only compatible with certain refrigerants.

Heat exchanger 250 may then discharge each refrigerant. For example, heat exchanger 250 may discharge the first refrigerant to the first load 230 and discharge the second refrigerant to second compressor 215. In this manner, heat exchanger 250 allows heat to be transferred from the first refrigerant to the second refrigerant while maintaining the integrity of each cycle which removes heat from their respective loads.

The sum of first load 230 and second load 235 may be represented by a total load 240. As installation of the new system progresses, second load 235 may represent a larger fraction of total load 240 (and first load 230 may represent a smaller fraction of total load 240). This occurs as more loads, such as additional freezers or refrigerated shelves, are switched over to the new system and use the second refrigerant. Eventually, the second load 235 will be equal to total load 240 and the old system may be removed.

In particular embodiments, first high side heat exchanger 220 receives the first refrigerant from first compressor 210 and removes heat from the first refrigerant. Cooling system 200 may further comprise a part load path 270. Part load path 270 may be coupled to heat exchanger 250 and first high side heat exchanger 220. In such embodiments, the first refrigerant may first flow from first compressor 210 to first high side heat exchanger 220 before flowing to the heat exchanger 250 through the part load path 270. In contrast with embodiments not having part load path 270, whether the first refrigerant flows directly from first compressor 210 to heat exchanger 250 or to first high side heat exchanger 220 may be controlled depending on operating conditions or the desired transfer of heat to the second refrigerant.

In certain embodiments, cooling system 200 further comprises one or more valves controlling the flow of the first refrigerant into heat exchanger 250. For example, cooling system 200 may include a compressor path valve 274 disposed between first compressor 210 and heat exchanger 250 and a part load path valve 275 disposed between first high side heat exchanger 220 and heat exchanger 250. Each of compressor path valve 274 and part load path valve 275 may be opened or closed, or partially opened allowing first refrigerant to flow to heat exchanger 250. For example, the states of compressor path valve 274 and part load path valve 275 may cause cooling system 200 to operate in one of two states. In a first state, compressor path valve 274 may be opened and part load path valve 275 may be closed. In this state, the first refrigerant flows from first compressor 210 to heat exchanger 250 and not through part load path 270. In a second state, compressor path valve 274 may be closed and part load path valve 275 may be opened. In this state, the first refrigerant flows through first high side heat exchanger 220 from first compressor 210 before flowing through part load path 270 to heat exchanger 250. In particular embodiments, cooling system 200 includes only one valve which controls the flow of the first refrigerant into heat exchanger 250.

As an example, when the new cooling system is first installed, second load 235 may represent only a small fraction of total load 240. Because second load 235 may be much lower than the new cooling system's capacity, more heat transfer to the second refrigerant may improve the operating efficiency of the new cooling system. In this situation, heat exchanger 250 should receive the first refrigerant directly from first compressor 210 because the first refrigerant will be at a higher temperature and be able to transfer more heat to the second refrigerant. After more stages of the new system are installed, second load 235 may represent a larger portion of total load 240. In this case, less heat transfer to the second refrigerant may be needed. To lower the amount of heat transfer, the first refrigerant may first have heat removed by first high side heat exchanger 220 before being received by heat exchanger 250. Thus, depending on the progress of the installation of the new system, an operator may determine from which path heat exchanger 250 may receive the first refrigerant.

Cooling system 200 may further include a pressure sensor 283 and a controller 260. Pressure sensor 283 may measure a pressure of the second refrigerant as it flows back to second compressor 215. Controller 260 is communicatively coupled to pressure sensor 283, such that it may receive information from pressure sensor 283, such as the measured pressure of the second refrigerant. Controller 260 may compare the measured pressure to a pressure set point. After making the comparison, controller 260 may increase a flow of the first refrigerant to heat exchanger 250. The pressure set point used in the comparison may be a predetermined parameter based on the characteristics of second compressor 215 or alternatively, may be determined by controller 260 based on other information.

As an example, a new cooling system compressor rack may have a minimum suction pressure at which it may operate efficiently. In that case, a pressure set point may be set at that minimum pressure, or slightly above it. Controller 260 may help maintain the pressure at efficient operating levels by increasing the flow of the first refrigerant in response to the measured pressure dipping below the pressure set point. By increasing the flow of the first refrigerant to heat exchanger 250, the thermal load on second compressor 215 is increased because more heat from the first refrigerant is available to be transferred to the second refrigerant. As a result, the pressure of the second refrigerant at the suction of second compressor 215 increases due to the increased transfer of heat.

There may be a number of ways to control (e.g., increase and/or decrease) the flow of first refrigerant into heat exchanger 250. In particular embodiments, as shown in FIG. 2, cooling system 200 may include pressure regulation valve 273. Pressure regulation valve 273 may be operated to restrict the flow of the first refrigerant to first load 230, thereby directing a larger portion of the total flow towards the branch leading to heat exchanger 250. For example, pressure regulation valve 273 may be set to provide a certain pressure downstream from first high side heat exchanger 220 that corresponds to the desired flow of the first refrigerant to heat exchanger 250. In some embodiments, pressure regulation valve 273 or other means to control the flow of the first refrigerant may be controlled automatically, such as by controller 206.

Compressors and cooling systems in general, may operate most efficiently at particular refrigerant temperatures and/or pressures. The flow of the second refrigerant may be controlled in order to provide an optimal pressure and temperature as it flows to second compressor 215. One key idea for optimization is the idea of the superheat of the refrigerant. Superheat is the difference between the temperature of the refrigerant and the saturation temperature of the refrigerant. The saturation temperature is a pressure-dependent value representing the temperature at which the refrigerant changes phase, e.g. from a liquid to a gas. Different systems may require different superheat of the refrigerant as it is compressed. Operating at too low of a superheat may damage the cooling system and operating at too high of a superheat may waste energy and reduce efficiency.

In particular embodiments, cooling system 200 may further include pressure sensor 281, temperature sensor 282, and controller 260. Pressure sensor 281 may measure a pressure of the second refrigerant and temperature sensor 282 may measure a temperature of the second refrigerant. For example, pressure sensor 281 and temperature sensor 282 may make measurements of the second refrigerant as it leaves heat exchanger 250. Controller 260 may be communicatively coupled to pressure sensor 281 and temperature sensor 282 such that it receives measured pressures and temperatures of the second refrigerant. Controller 260 may increase and/or decrease the flow of the second refrigerant from second compressor 215, through second high side heat exchanger 225, to heat exchanger 250 based on the measured temperature and the measured pressure.

In some embodiments, the controller 260 may use the measured pressure and measured temperature by first determining a saturation temperature based on the measured pressure. After determining the saturation temperature, controller 260 can then calculate a differential between the measured temperature and the determined saturation temperature. The differential represents the actual superheat of the second refrigerant as it leaves heat exchanger 250.

After determining the superheat of the second refrigerant, controller 260 compares it to a differential set point, e.g. a target superheat. An operator may determine the optimal superheat or differential set point at which the system should be operated. As discussed above, deviation from the optimal ranges for superheat may have significant consequences, including potentially damaging the cooling system.

In particular embodiments, cooling system 200 further includes expansion valve 271 disposed between second high side heat exchanger 225 and heat exchanger 250. Based on the comparison of the determined superheat and the differential set point, controller 260 may increase a flow of the second refrigerant from second compressor 215 to heat exchanger 250 by opening expansion valve 271. By opening expansion valve 271, the flow of the second refrigerant is less restricted from second compressor 215 through high side heat exchanger 225 to heat exchanger 250 causing the superheat to decrease. In some embodiments, expansion valve 271 is an electronic expansion valve ("EEV"). For example, if the differential set point is 5° F. and controller 260 calculates the superheat of the second refrigerant to be 6° F., based on a comparison of those two differentials, controller 260 may open an EEV between the high side heat exchanger 225 and the heat exchanger 250 to decrease the superheat of the second refrigerant.

In particular embodiments, controller 260 may also compare the measured pressure to a pressure set point. Based on its comparison, controller 260 may decrease a flow of the second refrigerant from heat exchanger 250 to second compressor 215 by closing a valve between heat exchanger 250 and second compressor 215. In some embodiments, cooling system 200 may further include pressure valve 272 disposed between heat exchanger 250 and second compressor 215.

As mentioned earlier, cooling system operation may depend on the characteristics of the refrigerant used, including the pressure of the refrigerant as it goes to the suction of a compressor. As an example, controller 260 may receive a pressure from pressure sensor 281 which is lower than a predetermined operating pressure. In this case, controller may operate pressure valve 272 to restrict the flow of the second refrigerant from heat exchanger 250 to second compressor 215. By restricting the flow, the pressure of the second refrigerant may increase toward the desired set point. Furthermore, restricting the flow of the second refrigerant from heat exchanger 250 may reduce the thermal stresses on heat exchanger 250. In particular embodiments, pressure valve 272 is an evaporator pressure regulator valve ("EPR"). Using an EPR valve may allow for larger temperature differences between the first refrigerant and the second refrigerant in heat exchanger 250. In such cases, the EPR helps to reduce thermal stresses on heat exchanger 250. Although an EEV valve and EPR valve are recited above, other suitable valves used to control the flow of refrigerant in cooling systems may be used.

The various embodiments described above may be combined in a variety of combinations in a cooling system. For example, pressure sensor 281 and pressure sensor 283 may be the same pressure sensor or may be two separate pressure sensors, as illustrated in FIG. 2. Additionally, embodiments including controller 260 may be combined such that controller 260 controls the flow of the first refrigerant and the second refrigerant. In another case, controller 260 may be configured to control the flow of the second refrigerant both to and from heat exchanger 250 in order to maintain optimal superheat and pressure.

This disclosure contemplates controller 260 including any combination of hardware (e.g., a processor and a memory). A processor of controller 260 may be any electronic circuitry, including, but not limited to microprocessors, application specific integrated circuits (ASIC), application specific instruction set processor (ASIP), and/or state machines, that communicatively couples to a memory of controller 325 and controls the operation of the climate control system. The processor may be 8-bit, 16-bit, 32-bit, 64-bit or of any other suitable architecture. The processor may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. The processor may include other hardware and software that operates to control and process information. The processor executes software stored on memory to perform any of the functions described herein. The processor controls the operation and administration of the cooling system by processing information. The processor may be a programmable logic device, a microcontroller, a microprocessor, any suitable processing device, or any suitable combination of the preceding. The processor is not limited to a single processing device and may encompass multiple processing devices.

The memory may store, either permanently or temporarily, data, operational software, or other information for the processor. The memory may include any one or a combination of volatile or non-volatile local or remote devices suitable for storing information. For example, the memory may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in the memory, a disk, a CD, or a flash drive. In particular embodiments, the software may include an application executable by the processor to perform one or more of the functions described herein.

FIG. 3 is a flowchart illustrating a method 300 of operating the example cooling system of FIG. 2. In particular embodiments, various components of cooling system 200 perform the steps of method 300.

In step 302, first compressor 210 compresses a first refrigerant. The first refrigerant may be sent to first load 230. Before reaching first load 230, the first refrigerant may first flow through first high side heat exchanger 220. In step 304, cooling system 200 removes, by first load 230, heat from a space using the first refrigerant. Then, first load 230 may send the first refrigerant back to first compressor 210 in order to repeat the cycle.

In step 306, second compressor 215 compresses a second refrigerant. The second refrigerant may be sent to second load 235. In step 308, the second refrigerant may be used to remove heat from a second space by second load 235.

In step 310, heat exchanger 250 may receive a first refrigerant from first compressor 210. In this step, the refrigerant may be received directly from first compressor 210 or indirectly from first compressor 210 through first high side heat exchanger 220. In step 312, heat exchanger 250 may also receive the second refrigerant from second compressor 215. Heat exchanger 250 may receive the second refrigerant from second compressor 215 after the second refrigerant flows through second high side heat exchanger 225.

In step 314, the heat exchanger 250 transfers heat from the first refrigerant to the second refrigerant at the heat exchanger 250.

In step 316, the heat exchanger 250 may discharge the first refrigerant to the first load 230. In step 318, the heat exchanger 250 may discharge the first refrigerant to the second compressor 215.

In this manner, heat exchanger 250 allows the exchange of heat between two refrigerants used in two different cooling cycles. Heat is transferred in heat exchanger 250 from the first refrigerant to the second refrigerant in step 314. The transfer of heat increases the perceived load at second compressor 215. In other words, second compressor 215 operates as if second load 235 represented a larger portion of total load 240. As a result, compressor 215 operates more efficiently and less likely to fail.

In particular embodiments, method 300 further comprises additional steps. These additional steps may correspond to different embodiments of cooling system 200, as described above. For example, in particular embodiments method 300 may include steps of controlling the flow of the first refrigerant, controlling the flow of the second refrigerant, opening or closing valves (e.g. one or more of expansion valve 271, pressure valve 272, pressure regulation valve 273, compressor path valve 274, and part load path valve 275), flowing the first refrigerant through part load path 270, measuring temperatures and pressures, comparing temperatures and pressures to set points, or any other steps required to operate the different embodiments discussed previously.

Modifications, additions, or omissions may be made to method 300 depicted in FIG. 3. Method 300 may include more, fewer, or other steps. For example, steps may be performed in parallel or in any suitable order. While discussed as various components of cooling system 200 performing the steps, any suitable component or combination of components of system 200 may perform one or more steps of the method.

FIG. 4 illustrates an example cooling system according to an embodiment. Cooling system 400 includes a first compressor 410, a first high side heat exchanger 420, a first load 430, a second compressor 415, a second high side heat exchanger 425, a second load 435, a first heat exchanger 450, and a second heat exchanger 455.

Cooling system 400 resembles cooling system 200 in FIG. 2, but differs in several respects. Notably, cooling system 400 comprises an additional heat exchanger, second heat exchanger 455. With the two heat exchangers, the first refrigerant and the second refrigerant do not flow to a common heat exchanger. For example, first heat exchanger 450 receives the first refrigerant from first compressor 410 and transfers heat from the first refrigerant to a fluid at first heat exchanger 450. Second heat exchanger 455 receives the second refrigerant from second compressor 415 through second high side heat exchanger 425 and transfers heat from the fluid to the second refrigerant.

An additional difference from cooling system 200 is the introduction of a fluid which is used to transfer heat between the two refrigerants. The fluid may be any suitable fluid enabling the transfer of heat to and from the fluid. In particular embodiments, the fluid comprises glycol. Glycol mixed with water may provide an efficient mix allowing for the transfer of heat from the first refrigerant to the second refrigerant. In other embodiments, the fluid is water. As will be described in particular embodiments described below, using such a fluid may enhance the control of the transfer of heat from the first refrigerant to the second refrigerant.

In particular embodiments, cooling system 400 includes a high side heat exchanger 420 configured to receive the first refrigerant from first compressor 410 and to remove heat from the first refrigerant. First high side heat exchanger 420 removes heat from the first refrigerant before it is received at first heat exchanger 450. The first refrigerant may flow from high side heat exchanger 420 to the first heat exchanger 450 through a part load path 470. As discussed previously, first heat exchanger 450 receiving the first refrigerant from part load path 470 may be desired when second load 435 represents a larger portion of total load 440, thereby reducing the need for additional thermal load at second compressor 415.

Whether the first refrigerant flows through part load path 470 may be controlled by opening and closing one or move valves connecting first compressor 410 and first heat exchanger 450. In particular embodiments, cooling system 400 includes a compressor path valve 474 disposed between first compressor 410 and first heat exchanger 450 and a part load path valve 475 disposed between first high side heat exchanger 420 and first heat exchanger 450. Each of compressor path valve 474 and part load path valve 475 may be opened or closed, or partially opened allowing first refrigerant to flow to heat exchanger 450. As discussed previously, the valves may be operated in order to control the flow of first refrigerant to first heat exchanger 450. Reference may be made to similar embodiments discussed in relation to FIG. 2 and cooling system 200.

In particular embodiments, cooling system 400 includes a pump 490 configured to circulate the fluid between first heat exchanger 450 and second heat exchanger 455. Pump 490 may allow the fluid to optimally transfer heat between the first refrigerant and the second refrigerant. For example, circulating the fluid using the pump 490 may allow a constant exchange of heat between the first refrigerant to the fluid and the fluid to the second refrigerant. In certain embodiments, pump 490 has a variable frequency drive which has an adjustable speed controlled by varying motor input frequency and voltage. Adjusting the speed of circulation may have certain advantages, such as providing finer control of the transfer of heat between the refrigerants.

The flow of the fluid between first heat exchanger 450 and second heat exchanger 455 may be modulated to provide the optimal heat transfer between the first refrigerant and the second refrigerant. The optimal heat transfer may be indicated by target parameters, or set points. As an example, an operator may determine a target heat differential across first heat exchanger 450 representing the difference in temperature of the fluid before and after flowing in first heat exchanger 450. Cooling system 400 may use these set points in order to control certain aspects of the systems, such as the flow of refrigerants and/or the fluid.

In particular embodiments, cooling system 400 includes a first temperature sensor 484 configured to measure a first temperature of the fluid and a second temperature sensor 485 configured to measure a second temperature of the fluid. In this embodiment, the cooling system 400 includes a controller 460 which is communicatively coupled to the first temperature sensor 484 and the second temperature sensor 485 such that controller 460 receives measured temperatures from the sensors. Controller 460 calculates a differential between the measured first temperature and the measured second temperature. Controller 460 then compares this differential to a set point and increases and/or decreases a flow of the fluid based on the comparison.

As an example, an operator may determine that a differential set point of five degrees across first heat exchanger 450 provides the optimal heat transfer to the second refrigerant (e.g., optimal increase in thermal load). First temperature sensor 484 may measure the temperature of the fluid as it flows from second heat exchanger 455 into first heat exchanger 450. Second temperature sensor 485 measures the temperature of the fluid as it exits first heat exchanger 450 on its way to second heat exchanger 455. Based on those temperature readings, controller 460 calculates the difference of temperature of the fluid before and after first heat exchanger 450 and compare that difference to the five degree differential set point. If, for example, the calculated difference is seven degrees, controller 460 may increase the flow of the fluid such that the difference may decrease. In this manner, controller 460 may help operate cooling system 400 at desired levels of heat transfer.

The process of receiving measured temperatures and controlling the flow of the fluid may be continuous, or occur periodically. For example, controller 206 may check the temperatures from the temperature sensors only every five, ten, or sixty seconds. In another example, the controller may continually update its temperature data from the temperatures sensors in order to control the flow of the fluid in substantially real-time.

Cooling system 400 may include other sensors and controller 460. In particular embodiments, controller 460 increases and/or decreases the flow of the first refrigerant to first heat exchanger 450 using a measured pressure of the second refrigerant. In some embodiments, cooling system 400 further includes pressure regulation valve 473. Pressure regulation valve 473 may be operated to restrict the flow of the first refrigerant to first load 430, thereby directing a larger portion of the total flow towards the branch leading to first heat exchanger 450. For example, pressure regulation valve 473 may be set to provide a certain pressure downstream from first high side heat exchanger 420 that corresponds to the desired flow of the first refrigerant to first heat exchanger 450. In some embodiments, pressure regulation valve 473 or other means to control the flow of the first refrigerant may be controlled automatically, such as by controller 406.

In particular embodiments, controller 460 controls the flow of the second refrigerant into second heat exchanger 455 based on the measured pressure and temperature of the second refrigerant. In some embodiments, cooling system 400 includes expansion valve 471 disposed between second high side heat exchanger 425 and second heat exchanger 455. In some embodiments, expansion valve 471 is an electronic expansion valve. In certain embodiments, controller 460 opens expansion valve 471 to increase a flow of the second refrigerant from second compressor 415 through second high side heat exchanger 425 to second heat exchanger 455.

In particular embodiments, cooling system 400 includes a pressure valve 472 disposed between second heat exchanger 455 and second compressor 415. In certain embodiments, controller 460 closes pressure valve 472 to decrease a flow of the second refrigerant from second heat exchanger 455 to second compressor 415. In some embodiments, pressure valve 472 is an evaporator pressure regulation valve. Reference may be made to similar embodiments discussed in relation to FIG. 2 and cooling system 200.

As discussed previously, valves between second compressor 415 or second high side heat exchanger 425 and second heat exchanger 455 may include any suitable valve able to be controlled by controller 460. Valves may include an electronic expansion valve and/or an evaporator pressure regulation valve. Persons having skill in the art would recognize that different valves may be used in order to control the pressure and temperature of a refrigerant to and from a heat exchanger and compressor.

FIG. 5 is a flowchart illustrating a method 500 operating the example cooling system 400 of FIG. 4. In particular embodiments, various components of cooling system 400 may perform steps of method 500.

In step 502, first compressor 410 compresses a first refrigerant. The first refrigerant may flow to a first load 430. At step 504, the first refrigerant may be used to remove heat from a first space by a first load 430. After removing heat form the first space at first load 430, the first refrigerant may be cycled back to first compressor 410.

At step 506, a second compressor 415 compresses a second refrigerant. The second refrigerant may be sent to a second load 435. At step 508 heat may be removed from the second space by the second load 435 using the second refrigerant.

First refrigerant may flow from the first compressor 410 and/or the first high side heat exchanger 420 to a first heat exchanger 450. At step 510, the first heat exchanger 450 receives the first refrigerant. At step 512, the first heat exchanger 450 transfers heat from the first refrigerant to a fluid.

The second refrigerant may flow from second compressor 415 to second heat exchanger 455. At step 514, the second heat exchanger 455 receives the second refrigerant. Second heat exchanger 455 may receive the second refrigerant from second compressor 415 after the second refrigerant flows through second high side heat exchanger 225. At step 516, second heat exchanger 455 transfers heat from the fluid to the second refrigerant.

In this manner, heat is transferred in first heat exchanger 450 from the first refrigerant to the fluid and heat is transferred from the fluid to the second refrigerant in second heat exchanger 455. Thus, heat is transferred from the first refrigerant to the second refrigerant using an intermediary fluid to carry the heat between heat exchangers.

In particular embodiments, method 500 includes additional steps. These additional steps may correspond to different embodiments of cooling system 400, as described above. For example, in particular embodiments method 500 may include steps of controlling the flow of the first refrigerant, controlling the flow of the second refrigerant, controlling the flow of the fluid between heat exchangers, opening or closing valves (e.g. one or more of expansion valve 471, pressure valve 472, pressure regulation valve 473, compressor path valve 474, and part load path valve 475), flowing the first refrigerant through part load path 470, measuring temperatures and pressures, comparing temperatures and pressures to set points, or any other steps required to operate the different embodiments discussed previously.

Modifications, additions or omissions may be made to method 500 depicted in FIG. 5. Method 500 may include more, fewer or other steps. For example, steps may be performed in parallel or in any suitable order. While discussed as various components of cooling system 400 performing the steps, any suitable component or combination of components of system 400 may perform one or more steps of the method.

FIG. 6 illustrates an example cooling system according to an embodiment. Cooling system 600 includes a compressor 610, a high side heat exchanger 620, a second load 635, a first load 630, a heat exchanger 650 and a heater 695. Heat exchanger 650 transfers heat from a fluid heated by heater 695 to a refrigerant compressed by compressor 610 and used to remove heat from a space proximate second load 635.

Cooling system 600 resembles cooling system 200 in FIG. 2 and cooling system 400 in FIG. 4, but differs from those examples in several respects. Notably, cooling system 600 does not use a separate refrigerant from an old cooling system as the heat source for adding heat to the refrigerant of the new cooling system. Instead, heater 695 adds heat to a fluid which then exchanges heat with the refrigerant in heat exchanger 650. Such an embodiment may have the advantage of providing an additional thermal load to a new cooling system without redirecting the refrigerant from the old system. Alternatively, the new cooling system may be installed in a building without an old cooling system. Cooling system 600 would allow the new cooling system to run efficiently at various stages of installation by supplying an external source of heat.

Heater 695 may be any suitable source of heat able to transfer heat to a fluid. For example, heater 695 may be an electric heater which may change its power outpoint (the amount of heat) based on varying input voltages. Persons having skill in the art would recognize there may be a variety of different types of heaters able to heat a fluid in cooling system 600, such as for example gas heaters, coal heaters, and/or furnaces.

A point of similarity between cooling system 400 and cooling system 600 is the use of a fluid to transfer heat to the refrigerant. As discussed in reference to FIG. 4, the flow of fluid may be controlled to provide the optimal amount of heat transfer to the refrigerant. In certain embodiments, cooling system 600 includes a pump 690 configured to circulate the fluid between the heater 695 in the heat exchanger 650. As discussed previously, modulating the speed of the pump may change the circulation speed of the fluid between the heat exchanger 650 and heater 695, and thereby the amount of thermal load transferred to the compressor 610 through the refrigerant.

Similar to certain embodiments of cooling system 400, cooling system 600 may include temperature sensors, first temperature sensor 684 and second temperature sensor 685, which controller 660 may receive measurements from in order to control the flow of the fluid. Similar to cooling system 400, the circulation of the fluid between heater 695 and heat exchanger 650 may be controlled based on the temperature differential across heat exchanger 650. By controlling the circulation of the fluid, controller 660 may modulate the amount of heat transferred to the refrigerant.

Similar to certain embodiments of cooling system 200 and cooling system 400, cooling system 600 may include other sensors and controller 660. In particular embodiments, controller 660 may control the flow of the refrigerant into heat exchanger 650 based on the measured pressure and temperature of the refrigerant. In some embodiments, cooling system 600 includes expansion valve 671 disposed between high side heat exchanger 620 and heat exchanger 650. In these embodiments, controller 660 may open expansion valve 671 to increase a flow of the refrigerant to heat exchanger 650 from compressor 610 through high side heat exchanger 620. In some embodiments, expansion valve 671 is an electronic expansion valve.

In particular embodiments, cooling system 600 includes pressure valve 672 disposed between heat exchanger 650 and compressor 610. In some embodiments, controller 660 closes pressure valve 672 to decrease a flow of the refrigerant from heat exchanger 650. In some embodiments, pressure valve 672 is an evaporator pressure regulation valve. Reference may be made to similar embodiments discussed in relation to FIGS. 2 and 4 and cooling systems 200 and 400.

As discussed previously, valves between compressor 610 or high side heat exchanger 620 and heat exchanger 650 may include any suitable valve able to be controlled by controller 660. Valves may include an electronic expansion valve and/or an evaporator pressure regulation valve. Persons having skill in the art would recognize that different valves may be used in order to control the pressure and temperature of a refrigerant to and from a heat exchanger and compressor.

As noted earlier, instead of using another refrigerant as a source of heat, cooling system 600 uses heat added by heater 695. The amount of heat added to the fluid by heater 695 may be controlled in order to provide the optimal heat transfer to the refrigerant in heat exchanger 650. In particular embodiments, cooling system 600 includes pressure sensor 683 which measures a pressure of the refrigerant. Cooling system 600 includes controller 660 communicatively coupled to pressure sensor 683 such that controller 660 may receive the measured pressure of the refrigerant. Using a pressure set point, controller 660 compares the measured pressure to the set point. If the comparison shows that the measured pressure is below the pressure set point, controller 660 increases the heat added by heater 695 to the fluid. In this manner, an operator may automatically control the heat transferred to the refrigerant to maintain an optimal thermal load.

As discussed above, compressor 610 may operate most efficiently above a certain threshold thermal loads. Those thermal loads may be represented by the temperature and pressure of the refrigerant flowing into compressor 610. If second load 635 does not provide sufficient thermal load, additional heat may be added through heater 695. After second load 635 represents a larger portion of total load 640, the amount of heat transferred to refrigerant may be reduced. For example, controller 660 may lower the amount of heat added by heater 695 by turning off a heating element.

Certain features of cooling system 600, including but not limited to heater 695, may be combined with or augment certain embodiments of cooling systems 200 and 400 disclosed in this specification. For example, heater 695 may be added to cooling system 200 or 400, for example, in order to provide supplemental heat in additional to heat from the first refrigerant coming from first compressor, 210 or 410. Supplemental heat may be useful when heat from the first refrigerant is not sufficient to add the necessary thermal load to the new cooling system.

In certain embodiments, heater 695 and heat exchanger 650 may be combined in a single unit such that the fluid does not require circulation or such that heat transfer is possible without an intermediary fluid (instead heater 695 heats heat exchanger 650 directly to provide heat to the refrigerant). Suitable combinations and modifications may be contemplated in order to finely tune the optimal load at compressor 610.

FIG. 7 is a flowchart illustrating a method 700 of operating the example cooling system 600 of FIG. 6. In particular embodiments, various components of cooling system 600 perform the steps of method 700.

In step 702, compressor 610 compresses a refrigerant. The compressed refrigerant may flow to a high side heat exchanger 620 and then to second load 635. At step 704, heat is removed from a space using the refrigerant proximate to the second load 635. After the refrigerant is used to remove heat from the space by second load 635 it may flow back to compressor 610.

A fluid may be present in a heater 695. At step 706, heater 695 heats the fluid. After adding heat to the fluid, the fluid may flow from heater 695 to heat exchanger 650.

At step 708, heat exchanger 650 receives the heated fluid. At step 710, heat exchanger 650 may receive a refrigerant at the heat exchanger 650. The refrigerant may flow from compressor 610 to heat exchanger 650 through high side heat exchanger 620.

After receiving both the fluid and the refrigerant at heat exchanger 650, in step 712, heat exchanger 650 transfers heat from the fluid to the refrigerant. Once heat has been transferred from the fluid to the refrigerant, heat exchanger 650 may discharge both the refrigerant and the fluid. Specifically, in step 714, the heat exchanger 650 discharges the refrigerant back to compressor 610, and at step 716, heat exchanger 650 discharges the fluid back to heater 695. In this manner, heat is transferred from the fluid to the refrigerant. That is, the refrigerant flowing into compressor 610 may be heated above a temperature that it would normally be after being used to remove heat from a space at the second load 635. As such, the thermal load on compressor 610 may be increased, causing an increase in efficiency.

In particular embodiments, method 700 may comprise additional steps. As an example, as discussed in relation to FIGS. 3 and 5, there may be additional steps to control the flow of the refrigerant to and from heat exchanger 650 and control the flow of the fluid between the heater 695 and heat exchanger 650. Such steps may be carried out by controller 660 of cooling system 600 or any other suitable means. For example, one or more of the steps may be carried out manually by an operator or may be carried out automatically.

Modifications, additions or omissions may be made to method 700 depicted in FIG. 7. Method 700 may include more, fewer or other steps. For example, steps may be formed in parallel or in any suitable order. While discussed as various components of cooling system 600 performed the steps, any suitable component or combination of components of system 600 may perform one or more of the steps above.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a first compressor configured to compress a first refrigerant;

a first load configured to:

use the first refrigerant to remove heat from a space proximate the first load; and send the first refrigerant to the first compressor;

a second compressor configured to compress a second refrigerant;

a second load configured to:

use the second refrigerant to remove heat from a space proximate the second load; and send the second refrigerant to the second compressor;

a first heat exchanger, configured to:

receive the first refrigerant from the first compressor; and transfer heat from the first refrigerant to a fluid; and a second heat exchanger, configured to:

receive the second refrigerant from the second compressor; and transfer heat from the fluid to the second refrigerant;

discharge the second refrigerant from the second heat exchanger after heat is transferred from the fluid to the second refrigerant, wherein the second refrigerant is discharged from the second heat exchanger to the second compressor before the second refrigerant reaches the second load.

2. The apparatus of claim 1, further comprising:

a high side heat exchanger configured to:

receive the first refrigerant from the first compressor; and remove heat from the first refrigerant; and a part load path coupled to the first heat exchanger and the high side heat exchanger, wherein the first refrigerant flows from the high side heat exchanger to the first heat exchanger through the part load path.

3. The apparatus of claim 1, further comprising a pump configured to circulate the fluid between the first heat exchanger and the second heat exchanger.

4. The apparatus of claim 1, further comprising:

a first temperature sensor configured to measure a first temperature of the fluid;

a second temperature sensor configured to measure a second temperature of the fluid; and a controller communicatively coupled to the first temperature sensor and the second temperature sensor, the controller configured to:

calculate a differential between the measured first temperature and the measured second temperature;

compare the differential to a set point; and increase a flow of the fluid based on the comparison of the calculated differential and the set point.

5. The apparatus of claim 1, further comprising a pressure sensor configured to measure a pressure of the second refrigerant; and a controller communicatively coupled to the pressure sensor, the controller configured to:

compare the measured pressure to a pressure set point; and increase a flow of the first refrigerant to the first heat exchanger based on the comparison of the measured pressure and the pressure set point.

6. The apparatus of claim 1, further comprising:

a pressure sensor configured to measure a pressure of the second refrigerant;

a temperature sensor configured to measure a temperature of the second refrigerant; and a controller communicatively coupled to the pressure sensor and the temperature sensor, the controller configured to increase a flow of the second refrigerant from the second compressor to the second heat exchanger based on the measured temperature and measured pressure.

7. The apparatus of claim 6, the controller further configured to:

determine a saturation temperature based on the measured pressure;

calculate a differential between the measured temperature and the determined saturation temperature;

compare the calculated differential to a differential set point; and based on the comparison between the calculated differential and the differential set point, increase a flow of the second refrigerant from the second compressor to the second heat exchanger by opening a valve between the second compressor and the second heat exchanger.

8. The apparatus of claim 6, the controller further configured to:

compare the measured pressure to a pressure set point; and based on the comparison between the measured pressure and the pressure set point, decrease a flow of the second refrigerant from the second heat exchanger to the second compressor by closing a valve between the second heat exchanger and the second compressor.

9. A method comprising:

compressing a first refrigerant at a first compressor;

removing heat from a first space using the first refrigerant;

compressing a second refrigerant at a second compressor;

removing heat from a second space using the second refrigerant;

receiving the first refrigerant from the first compressor at a first heat exchanger, transferring heat from the first refrigerant to a fluid at the first heat exchanger;

receiving the second refrigerant from the second compressor at a second heat exchanger;

transferring heat from the fluid to the second refrigerant at the second heat exchanger; and after transferring heat is transferred from the fluid to the second refrigerant, discharging the second refrigerant from the second heat exchanger to the second compressor, wherein the second refrigerant is discharged to the second compressor before the second refrigerant reaches the second load.

10. The method of claim 9, further comprising:

receiving the first refrigerant from the first compressor at a high side heat exchanger;

removing heat from the first refrigerant at the high side heat exchanger; and receiving the first refrigerant from the high side heat exchanger at the first heat exchanger through a part load path coupled to the first heat exchanger and the high side heat exchanger.

11. The method of claim 9, further comprising circulating the fluid between the first heat exchanger and the second heat exchanger using a pump.

12. The method of claim 9, further comprising:

measuring a first temperature of the fluid;

measuring a second temperature the fluid;

calculating a differential between the measured first temperature and the measured second temperature;

comparing the calculated differential to a set point; and increasing a flow of the fluid based on the comparison of the calculated differential and the set point.

13. The method of claim 9, further comprising measuring a pressure of the second refrigerant;

comparing the measured pressure from the pressure sensor to a pressure set point; and increasing a flow of the first refrigerant to the first heat exchanger based on the comparison of the measured pressure and the pressure set point.

14. The method of claim 9, further comprising:

measuring a pressure of the second refrigerant;

measuring a temperature of the second refrigerant; and increasing a flow of the second refrigerant from the second compressor to the second heat exchanger based on the measured temperature and measured pressure.

15. The method of claim 14, further comprising:

determining a saturation temperature based on the measured pressure;

calculating a differential between the measured temperature and the determined saturation temperature;

comparing the calculated differential to a differential set point; and based on the comparison between the calculated differential and the differential set point, increasing a flow of the second refrigerant from the second compressor to the second heat exchanger by opening a valve between the second compressor and the second heat exchanger.

16. The method of claim 14, further comprising:

comparing the measured pressure to a pressure set point; and based on the comparison between the measured pressure and the pressure set point, decreasing a flow of the second refrigerant from the second heat exchanger to the second compressor by closing a valve between the second heat exchanger and the second compressor.

17. A system comprising:

a first compressor configured to compress a first refrigerant;

a first load configured to:

use the first refrigerant to remove heat from a space proximate the first load; and send the first refrigerant to the first compressor;

a second compressor configured to compress a second refrigerant;

a second load configured to:

use the second refrigerant to remove heat from a space proximate the second load; and send the second refrigerant to the second compressor;

a first heat exchanger, configured to:

receive the first refrigerant from the first compressor; and transfer heat from the first refrigerant to a fluid;

a second heat exchanger, configured to:

receive the second refrigerant from the second compressor; and transfer heat from the fluid to the second refrigerant; and a high side heat exchanger configured to:

receive the first refrigerant from the first compressor; and remove heat from the first refrigerant;

wherein the second heat exchanger is further configured to discharge the second refrigerant from the second heat exchanger after heat is transferred from the fluid to the second refrigerant, wherein the second refrigerant is discharged from the second heat exchanger to the second compressor before the second refrigerant reaches the second load.

18. The system of claim 17, further comprising a part load path coupled to the first heat exchanger and the high side heat exchanger, wherein the first refrigerant flows from the high side heat exchanger to the first heat exchanger through the part load path.

19. The system of claim 17, further comprising:

a first temperature sensor configured to measure a first temperature of the fluid;

a second temperature sensor configured to measure a second temperature of the fluid; and a controller communicatively coupled to the first temperature sensor and the second temperature sensor, the controller configured to:

calculate a differential between the measured first temperature and the measured second temperature;

compare the differential to a set point; and increase a flow of the fluid based on the comparison of the calculated differential and the set point.

20. The system of claim 17, further comprising a pressure sensor configured to measure a pressure of the second refrigerant; and a controller communicatively coupled to the pressure sensor, the controller configured to:

compare the measured pressure to a pressure set point; and increase a flow of the first refrigerant to the first heat exchanger based on the comparison of the measured pressure and the pressure set point.

21. The system of claim 17, further comprising:

a pressure sensor configured to measure a pressure of the second refrigerant;

a temperature sensor configured to measure a temperature of the second refrigerant; and a controller communicatively coupled to the pressure sensor and the temperature sensor, the controller configured to increase a flow of the second refrigerant from the second compressor to the second heat exchanger based on the measured temperature and measured pressure.

22. The system of claim 21, the controller further configured to:

determine a saturation temperature based on the measured pressure;

calculate a differential between the measured temperature and the determined saturation temperature;

compare the calculated differential to a differential set point; and based on the comparison between the calculated differential and the differential set point, increase a flow of the second refrigerant from the second compressor to the second heat exchanger by opening a valve between the second compressor and the second heat exchanger.

23. The system of claim 21, the controller further configured to:

compare the measured pressure to a pressure set point; and based on the comparison between the measured pressure and the pressure set point, decrease a flow of the second refrigerant from the second heat exchanger to the second compressor by closing a valve between the second heat exchanger and the second compressor.

* * * * *